US011053929B2

(12) United States Patent
Matsuo et al.

(10) Patent No.: US 11,053,929 B2
(45) Date of Patent: Jul. 6, 2021

(54) VARIABLE DISPLACEMENT PUMP

(71) Applicant: KABUSHIKI KAISHA TOYOTA JIDOSHOKKI, Kariya (JP)

(72) Inventors: Tsutomu Matsuo, Kariya (JP); Naoya Yokomachi, Kariya (JP); Yuki Ueda, Kariya (JP); Takashi Uno, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 246 days.

(21) Appl. No.: 15/769,853

(22) PCT Filed: Sep. 23, 2016

(86) PCT No.: PCT/JP2016/078104
§ 371 (c)(1),
(2) Date: Apr. 20, 2018

(87) PCT Pub. No.: WO2017/068910
PCT Pub. Date: Apr. 27, 2017

(65) Prior Publication Data

US 2018/0328350 A1 Nov. 15, 2018

(30) Foreign Application Priority Data

Oct. 22, 2015 (JP) ..... JP2015-207670

(51) Int. Cl.
*F04B 1/324* (2020.01)
*F04B 1/22* (2006.01)
(Continued)

(52) U.S. Cl.
CPC ..... *F04B 1/324* (2013.01); *F04B 1/2035* (2013.01); *F04B 1/2078* (2013.01);
(Continued)

(58) Field of Classification Search
CPC ..... F04B 1/324; F04B 1/2035; F04B 1/2078; F04B 1/2085; F04B 1/22; F04B 1/34; F04B 1/395; F04B 49/002
(Continued)

(56) References Cited

U.S. PATENT DOCUMENTS 7,334,513 B2 * 2/2008 Belser ..... F04B 1/324 92/12.1
2005/0238501 A1 * 10/2005 Brailovskiy ..... F04B 1/148 417/222.1
(Continued)

FOREIGN PATENT DOCUMENTS

JP 8338357 A 12/1996
JP 10184532 A 7/1998
(Continued)

OTHER PUBLICATIONS

Communication dated Jul. 9, 2018, from the European Patent Office in counterpart European Application No. 16857228.7.
(Continued)

*Primary Examiner* — Philip E Stimpert
(74) *Attorney, Agent, or Firm* — Sughrue Mion, PLLC

(57) ABSTRACT

Provided is a variable displacement pump which sucks and discharges a working fluid by moving a piston with a stroke in response to an inclination angle of a swash plate, the variable displacement pump including: a control piston which includes a columnar piston portion pressing the swash plate and adjusts the inclination angle of the swash plate between a maximal inclination angle in which a discharge capacity of the working fluid becomes maximal and a minimal inclination angle in which the discharge capacity of the working fluid becomes minimal; a piston accommodation portion which is formed in the housing and accommodates the piston portion; and a pressed portion which is disposed between the swash plate and the piston portion and
(Continued)

is pressed toward the swash plate by the piston portion, in which when the inclination angle of the swash plate is an intermediate inclination angle in which the discharge capacity of the working fluid becomes an intermediate amount between the maximal amount and the minimal amount, a contact point between the piston portion and the pressed portion is located at a center portion including an axis center of the piston portion in an end surface on the side of the swash plate in the piston portion.

2 Claims, 5 Drawing Sheets

(51) Int. Cl.

| | |
|---|---|
| ***F04B 1/2035*** | (2020.01) |
| ***F04B 1/2085*** | (2020.01) |
| ***F04B 1/2078*** | (2020.01) |
| ***F04B 49/00*** | (2006.01) |
| ***F04B 1/34*** | (2006.01) |

(52) U.S. Cl.
CPC ..... *F04B 1/2085* (2013.01); *F04B 1/22* (2013.01); *F04B 1/34* (2013.01); *F04B 49/002* (2013.01)

(58) Field of Classification Search
USPC ..... 417/270
See application file for complete search history.

(56) References Cited

U.S. PATENT DOCUMENTS

| | | | | |
|---|---|---|---|---|
| 2010/0199837 | A1* | 8/2010 | Gray, Jr. ..... | F04B 49/16 91/472 |
| 2014/0328700 | A1* | 11/2014 | Iwanaji ..... | F04B 1/146 417/222.1 |
| 2017/0211556 | A1* | 7/2017 | Ueda ..... | F04B 1/32 |

FOREIGN PATENT DOCUMENTS

| | | | |
|---|---|---|---|
| JP | 2003113772 | A | 4/2003 |
| JP | 200670777 | A | 3/2006 |
| JP | 2007170280 | A | 7/2007 |
| JP | 2009542966 | A | 12/2009 |
| JP | 2015117658 | A | 6/2015 |
| WO | 2008006508 | A2 | 1/2008 |

OTHER PUBLICATIONS

International Preliminary Report on Patentability and Written Opinion Translation in International Application No. PCT/JP2016/078104, dated May 3, 2018.
International Search Report in International Application No. PCT/JP2016/078104, dated Dec. 27, 2016.

* cited by examiner

VARIABLE DISPLACEMENT PUMP

CROSS REFERENCE TO RELATED APPLICATIONS

This application is a National Stage of International Application No. PCT/JP2016/078104, filed on Sep. 23, 2016, which claims priority from Japanese Patent Application No. 2015-207670, filed on Oct. 22, 2015, the contents of these PCT and Japanese applications are hereby incorporated herein by reference.

TECHNICAL FIELD

The present invention relates to a variable displacement pump.

BACKGROUND ART

Hitherto, there is known a variable displacement pump which changes a discharge amount of the pump by changing an inclination angle of a swash plate. For example, Patent Literature 1 discloses a variable displacement pump which sucks and discharges a working fluid by moving a piston inside a cylinder block rotating together with a rotation shaft in a reciprocating manner with a stroke in accordance with an inclination angle of a swash plate. The variable displacement pump disclosed in Patent Literature 1 includes a control piston which includes a piston portion pressing the swash plate and controls the inclination angle of the swash plate and a housing which includes a piston accommodation portion accommodating the piston portion. The piston portion presses the swash plate through, for example, a cylindrical roll or the like.

CITATION LIST

Patent Literature

Patent Literature 1: Japanese Unexamined Patent Publication No. 2015-117658

SUMMARY OF INVENTION

Technical Problem

In the variable displacement pump disclosed in Patent Literature 1, a displacement of a contact point between the piston portion and the roll or the like occurs in response to the inclination angle of the swash plate. Due to this displacement or the like, a force in which the axial direction of the piston portion is tilted from a direction along the axis center of the piston accommodation portion is applied to the piston portion. When the piston portion slides inside the piston accommodation portion while such a force is exhibited, the piston portion is easily caught by the piston accommodation portion. Accordingly, the wear of the piston accommodation portion and the wear of the housing easily occur.

An object of the invention is to provide a variable displacement pump capable of suppressing a wear of a housing.

Solution to Problem

According to an aspect of the invention, there is provided a variable displacement pump which includes a rotation shaft rotatably supported by a housing, a cylinder block including a plurality of cylinder bores formed in the rotation shaft in a circumferential direction and rotating together with the rotation shaft, a piston provided inside each of the plurality of cylinder bores to be slidable, and a swash plate supported to be tiltable with respect to the rotation shaft while a front end portion of the piston is slidable thereon and which sucks and discharges a working fluid by moving the piston in a reciprocating manner with a stroke in response to an inclination angle of the swash plate, the variable displacement pump including: a control piston which includes a columnar piston portion pressing the swash plate and adjusts the inclination angle of the swash plate between a maximal inclination angle in which a discharge capacity of the working fluid becomes maximal and a minimal inclination angle in which the discharge capacity of the working fluid becomes minimal; a piston accommodation portion which is formed in the housing and accommodates the piston portion; and a pressed portion which is disposed between the swash plate and the piston portion and is pressed toward the swash plate by the piston portion, in which when the inclination angle of the swash plate is an intermediate inclination angle in which the discharge capacity of the working fluid becomes an intermediate amount between the maximal amount and the minimal amount, a contact point between the piston portion and the pressed portion is located at a center portion including an axis center of the piston portion in an end surface on the side of the swash plate in the piston portion.

In the variable displacement pump according to an aspect of the invention, when the inclination angle of the swash plate is the intermediate inclination angle, the contact point between the pressed portion and the piston portion of the control piston (hereinafter, simply referred to as a "contact point") is located at the center portion including the axis center of the piston portion in an end surface on the side of the swash plate in the piston portion. That is, the contact point is located on the axis center of the piston portion or in the vicinity of the axis center. With such a positional relation, it is possible to suppress a problem in which the displacement of the contact point from the axis center of the piston portion excessively increases when the inclination angle of the swash plate is any one of the maximal inclination angle and the minimal inclination angle. Accordingly, the displacement of the contact point toward the outer peripheral side of the piston portion from the axis center of the piston portion does not easily increase excessively when the inclination angle of the swash plate is any one of the maximal inclination angle and the minimal inclination angle. Here, a large force in which the axial direction of the piston portion is tilted from a direction along the axis center of the piston accommodation portion (hereinafter, referred to as a "tilting force") is applied to the piston portion as the position of the contact point is displaced toward the outer peripheral side of the piston portion from the axis center of the piston portion. In an aspect of the invention, since the displacement of the contact point from the axis center of the piston portion toward the outer peripheral side of the piston portion does not easily increase excessively, the tilting force applied to the piston portion can be suppressed. Thus, it is possible to suppress the wear of the piston accommodation portion generated when the piston portion slides inside the piston accommodation portion while the tilting force is applied to the piston portion and to suppress the wear of the housing.

In the variable displacement pump according to another aspect, the contact point may be located on the axis center of the piston portion when the inclination angle of the swash plate is the intermediate inclination angle. In this case, since the displacement of the contact point from the axis center of the piston portion toward the outer peripheral side of the piston portion is substantially the same when the inclination angle of the swash plate is the maximal inclination angle and when the inclination angle of the swash plate is the minimal inclination angle, the tilting force applied to the piston portion is further suppressed. Thus, it is possible to further suppress the wear of the piston accommodation portion generated when the piston portion slides inside the piston accommodation portion while the tilting force is applied to the piston portion and to further suppress the wear of the housing.

In the variable displacement pump according to another aspect, when the inclination angle of the swash plate is the intermediate inclination angle, the contact point may be located on the vertical reference line orthogonal to the axis center of the rotation shaft and passing through the rotation center of the swash plate. In this case, it is possible to suppress a problem in which the displacement of the contact point from the vertical reference line excessively increases when the inclination angle of the swash plate is any one of the maximal inclination angle and the minimal inclination angle. Accordingly, the inclination of the swash plate based on the vertical reference line does not easily increase excessively when the inclination angle is any one of the maximal inclination angle and the minimal inclination angle. That is, the displacement of the inclination angle of the swash plate based on the intermediate inclination angle is small. Thus, since it is possible to decrease the degree of the displacement of the contact point in response to the displacement of the inclination angle of the swash plate, it is possible to further suppress the tilting force applied to the piston portion due to the displacement of the contact point. As a result, it is possible to further suppress the wear of the piston accommodation portion and to further suppress the wear of the housing.

The variable displacement pump according to another aspect may further include a recessed portion which is formed in an end surface on the side of the swash plate in the piston portion. The working fluid filled around the piston portion or the swash plate etc. is stored in the recessed portion formed in an end surface on the side of the swash plate in the piston portion. Thus, a part between the piston portion and the pressed portion is reliably lubricated by the working fluid stored in the recessed portion and thus a friction force generated by the displacement of the contact point is reduced. Since the friction force is one of factors causing the tilting force applied to the piston portion, it is possible to further suppress the tilting force applied to the piston portion by reducing the friction force. Accordingly, it is possible to further suppress the wear of the piston accommodation portion generated when the piston portion slides inside the piston accommodation portion while the tilting force is applied to the piston portion and to further suppress the wear of the housing.

In the variable displacement pump according to another aspect, the axis center of the piston portion may be inclined with respect to the axis center of the rotation shaft. In this case, the contact point can be easily located at the center portion including the axis center of the piston portion in an end surface on the side of the swash plate in the piston portion, for example, even when the size of the swash plate etc. is not changed. As a result, a decrease in size can be realized.

Advantageous Effects of Invention

According to the invention, it is possible to suppress the wear of the housing.

DESCRIPTION OF EMBODIMENTS

Figure 1:
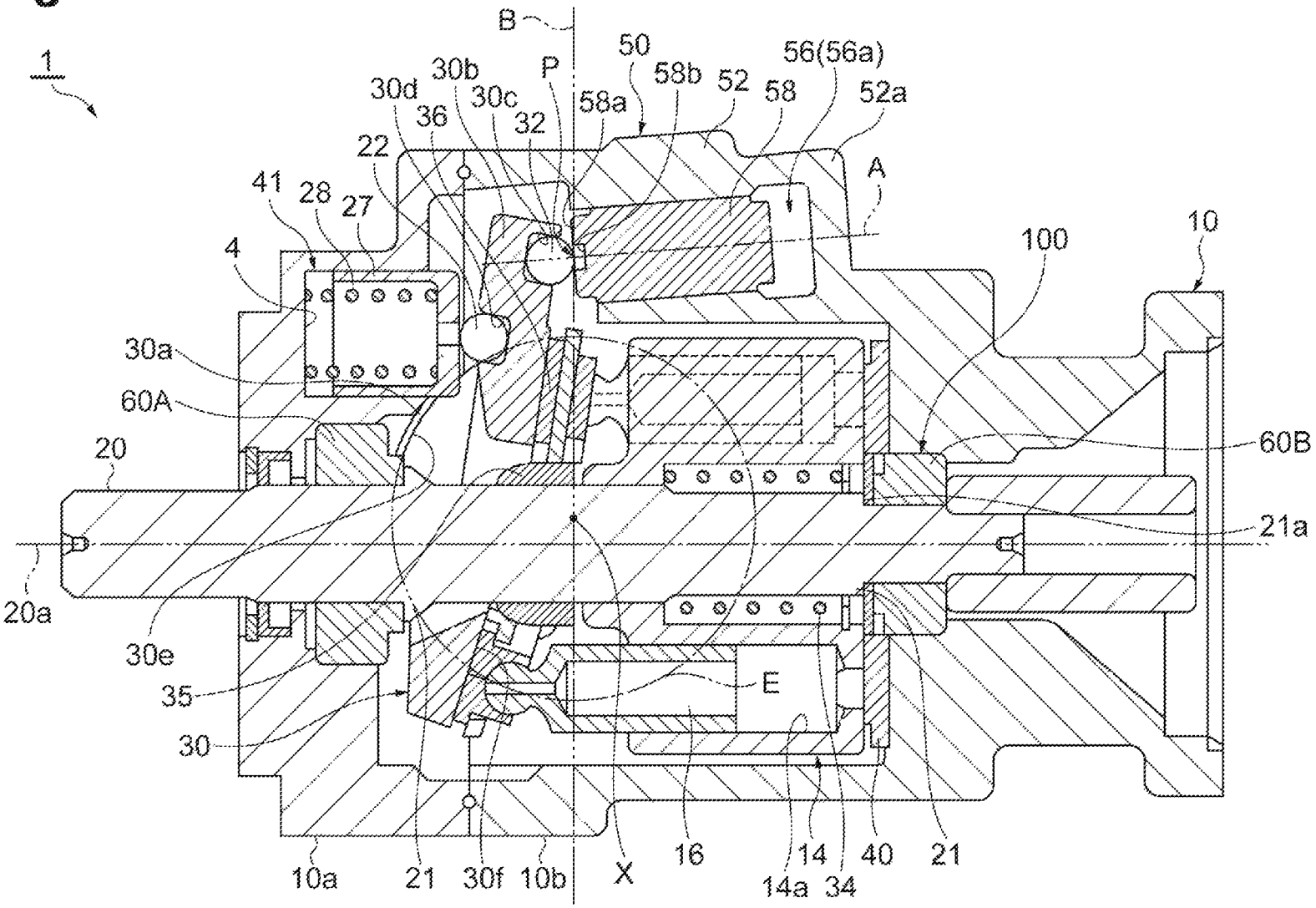
FIG. 1 is a schematic cross-sectional view illustrating a variable displacement pump according to an embodiment of the invention.

Hereinafter, embodiments of the invention will be described in detail with reference to the accompanying drawings. In the description, the same reference numerals will be used for the same components or components having the same function and a redundant description will be omitted.

First, a configuration of a variable displacement pump 1 according to the embodiment will be described. The variable displacement pump 1 will be described with reference to FIG. 1.

The variable displacement pump 1 includes a pump housing 10 (a housing), a rotation shaft 20 which is rotatably supported by the pump housing 10 and has an end portion protruding from the pump housing 10, a cylinder block 14 which has a plurality of cylinder bores 14*a* in the circumferential direction of the rotation shaft 20 and rotates along with the rotation shaft 20, a piston 16 which is provided to be slidable in each of the plurality of cylinder bores 14*a*, and a swash plate 30 which is supported to be tiltable with respect to the rotation shaft 20 while a front end portion of the piston 16 is slidable thereon. In the variable displacement pump 1, the piston 16 performs a reciprocating stoke in response to the inclination angle of the swash plate 30 so that a working fluid is sucked and discharged.

The pump housing 10 includes a front housing 10*a* and a main housing 10*b* and both members are integrated with each other by screw members (not illustrated).

The rotation shaft 20 of which one end portion and the other end portion are rotatably supported by bearing portions 60A and 60B is attached to the pump housing 10. The rotation shaft 20 is connected to a power output device (not illustrated) such as an engine or a motor at the end portion protruding from the pump housing 10. In accordance with the driving of the power output device, the rotation shaft 20 rotates.

The cylinder block 14 which is rotatably spline-fitted to the rotation shaft 20 is accommodated in the pump housing 10. The cylinder block 14 is provided with the plurality of cylinder bores 14*a* disposed at a predetermined interval in the circumferential direction of the rotation shaft 20. Each piston 16 is slidably inserted into each cylinder bore 14*a*. A shoe is attached to a head portion which is one end portion (a left end portion of FIG. 1) of each piston 16. These shoes are collectively held by a retainer plate 36.

The swash plate 30 is accommodated on the side of the front housing 10*a* inside the pump housing 10. The swash plate 30 is rotatably supported through a swash plate bearing 30*a* and is tiltable in the axial direction of the rotation shaft 20. When an urging force of a spring member 34 provided between the cylinder block 14 and the rotation shaft 20 is transmitted to the retainer plate 36 through a pivot 35, the retainer plate 36 is pressed against the swash plate 30. Further, each piston 16 slidably contacts the swash plate 30 through the shoe. Further, the cylinder block 14 is in press-contact with a valve plate 40 fastened to an inner end wall surface opposite to the front housing 10*a* in the main housing 10*b*.

The swash plate 30 is disposed to be rotatable about the rotation center X so that an inclination angle defining a stroke of the piston 16 is changeable. The position of the swash plate 30 is held by a swash plate bearing 30*a* disposed on the rear surface side (on the side opposite to the end surface facing the cylinder block 14). The swash plate 30 is disposed to contact a support surface 30*e* of the swash plate bearing 30*a*. The swash plate 30 is tiltable along the curvature of the support surface 30*e* of the swash plate bearing 30*a*. The swash plate 30 is tilted or rotated based on the rotation center X. That is, the swash plate 30 is tilted or rotated about the rotation center X. The rotation center X is also the curvature center of the support surface 30*e*. Additionally, in FIG. 1, the rotation center X is indicated by a point, but the tip of the rotation center X extends in the depth direction (a direction perpendicular to the drawing sheet).

A front surface side (an end surface side facing the cylinder block 14) of the swash plate 30 is formed as a flat surface 30*f*. One end portion of each piston 16 protruding from the cylinder block 14 slides on the flat surface 30*f* through a shoe. The inclination angle of the swash plate 30 is defined as, for example, the angle of the swash plate 30 based on the line orthogonal to an axis center 20*a* of the rotation shaft 20. In the embodiment, the inclination angle of the swash plate 30 is defined as an angle of the flat surface 30*f* orthogonal to the axis center 20*a* of the rotation shaft 20.

An edge portion 30*b* of the swash plate 30 is provided with a concave portion 30*c* on the side of the flat surface 30*f* of the swash plate 30. The concave portion 30*c* accommodates a cylindrical roll 32 (a pressed portion). The edge portion 30*b* of the swash plate 30 is provided with a concave portion 30*d* on the front end surface side opposite to the flat surface 30*f* The concave portion 30*d* accommodates a cylindrical roll 22.

An urging mechanism 41 which urges the roll 22 provided in the concave portion 30*d* of the swash plate 30 toward the cylinder block 14 is provided inside the front housing 10*a*. The urging mechanism 41 includes a spring receiving concave portion 42, a spring accommodating hollow piston 27, and a spring 28.

The spring receiving concave portion 42 is opened to the swash plate 30 in the front housing 10*a*. The spring accommodating hollow piston 27 is inserted into the spring receiving concave portion 42. The spring accommodating hollow piston 27 is provided to contact the swash plate 30 and to be slidable along the side surface of the spring receiving concave portion 42. In the spring accommodating hollow piston 27, the opposite side to the end surface facing the swash plate 30 is opened. The spring 28 is accommodated in the spring accommodating hollow piston 27. One end of the spring 28 contacts the surface of the spring receiving concave portion 42. The other end of the spring 28 contacts the inner wall surface of the spring accommodating hollow piston 27.

When the cylinder block 14 rotates together with the rotation shaft 20, each piston 16 moves in a reciprocating manner by a stroke specified by the inclination angle of the swash plate 30 and the cylinder bore 14*a* alternately communicates with an intake port (not illustrated) and a discharge port (not illustrated) formed in the valve plate 40 by penetrating to have a circular-arc shape. Accordingly, the working oil is sucked from the intake port into the cylinder bore 14*a* and the working oil inside the cylinder bore 14*a* is discharged from the discharge port by a pumping action. In addition, an intake passage (not illustrated) and a discharge passage (not illustrated) are formed at the wall portion on the other end side of the main housing 10*b* and respectively communicate with the intake port and the discharge port.

The variable displacement pump 1 further includes a control piston 50. The control piston 50 includes a piston portion 58 which presses the swash plate 30 and controls the inclination angle of the swash plate 30. The control piston 50 is accommodated in the piston accommodation portion 52 formed at the side portion of the main housing 10*b* of the pump housing 10.

The piston accommodation portion 52 extends in a direction inclined with respect to the rotation shaft 20 and has a substantially cylindrical shape extending toward the edge portion of the swash plate 30. That is, the axis center of the piston accommodation portion 52 is inclined with respect to the axis center 20*a* of the rotation shaft 20.

An end distant from the swash plate 30 in the piston accommodation portion 52 is blocked by a wall portion 52*a*. Accordingly, a piston accommodation room 56 is defined inside the piston accommodation portion 52. Additionally, an end distant from the swash plate 30 in the piston accommodation portion 52 may be blocked by, for example, a screw or the like. The piston accommodation room 56 accommodates the piston portion 58. In addition, a space between the piston portion 58 and the wall portion 52*a* in the piston accommodation room 56 serves as a control room 56*a* into which the working oil flows.

The piston portion 58 has a columnar shape in appearance. The diameter of the piston portion 58 is designed so that no gap is formed with respect to the inner wall surface of the piston accommodation room 56 and the piston portion 58 can slide in the piston accommodation room 56. The diameter of the piston portion 58 affects a decrease in volume and a returning speed and is appropriately adjusted according to the application. The axis center A of the piston portion 58 is inclined with respect to the axis center 20*a* of the rotation shaft 20. That is, the axis center A of the piston portion 58 follows the axial direction of the piston accommodation portion 52.

According to the control piston 50, it is possible to move the piston portion 58 toward the swash plate 30 in a reciprocating manner by controlling the working oil in the control room 56*a*. Then, when the piston portion 58 presses the roll 32 provided in the edge portion 30*b* of the swash plate 30, the inclination angle of the swash plate 30 is changed and thus the discharge capacity of the variable displacement pump 1 is changed. That is, the control piston 50 controls the inclination angle of the swash plate 30. The control piston 50 presses the roll 32 to adjust the inclination angle of the swash plate 30 between the maximal inclination angle in which the discharge capacity of the working fluid becomes maximal and the minimal inclination angle in which the discharge capacity of the working fluid becomes minimal.

When the swash plate 30 changes from the minimal inclination angle to the maximal inclination angle, the spring accommodating hollow piston 27 slides on the spring receiving concave portion 42 toward the swash plate 30 by the urging force of the spring 28. Then, the spring accommodating hollow piston 27 presses the swash plate 30 through the roll 22 and the swash plate 30 presses an end surface 58*a* of the piston portion 58 through the roll 32. Accordingly, the swash plate 30 is located at the maximal inclination angle so that the discharge amount of the variable displacement pump 1 becomes maximal (see FIG. 3).

Meanwhile, when the swash plate 30 changes from the maximal inclination angle to the minimal inclination angle, the working oil of which the flow amount is controlled by a control valve (not illustrated) flows into the control room 56*a*. In addition, the inflow amount of the working oil is controlled by a control valve (not illustrated). Then, the end surface 58*a* of the piston portion 58 presses the swash plate 30 through the roll 32 and the swash plate 30 presses the spring accommodating hollow piston 27 through the roll 22. For this reason, the spring accommodating hollow piston 27 slides on the spring receiving concave portion 42 toward the opposite side to the swash plate 30 against the urging force of the spring 28. Accordingly, the inclination angle of the swash plate 30 decreases so that the discharge amount of the variable displacement pump 1 decreases. Then, when the front end (the opening end) of the spring accommodating hollow piston 27 approaches or contacts the surface of the spring receiving concave portion 42, the swash plate 30 has the minimal inclination angle and thus the discharge amount of the variable displacement pump 1 becomes minimal.

In the variable displacement pump 1 of the embodiment, when the inclination angle of the swash plate 30 is located at the intermediate inclination angle, a contact point P between the piston portion 58 and the roll 32 (hereinafter, simply referred to as a "contact point P") is located at a center portion 58$a_1$ (see FIG. 2) of the end surface 58*a* of the piston portion 58. The intermediate inclination angle indicates the inclination angle of the swash plate 30 when the discharge amount of the variable displacement pump 1 becomes an amount between the maximal amount and the minimal amount, that is, an accurately intermediate amount between the maximal amount and the minimal amount. The contact point P indicates a point where the piston portion 58 and the roll 32 contact each other when viewed from the extension direction of the rotation center X (a direction perpendicular to the drawing sheet). In other words, the contact point P indicates a point where the piston portion 58 and the roll 32 contact each other on an imaginary cross-section orthogonal to the rotation center X.

Figure 2:
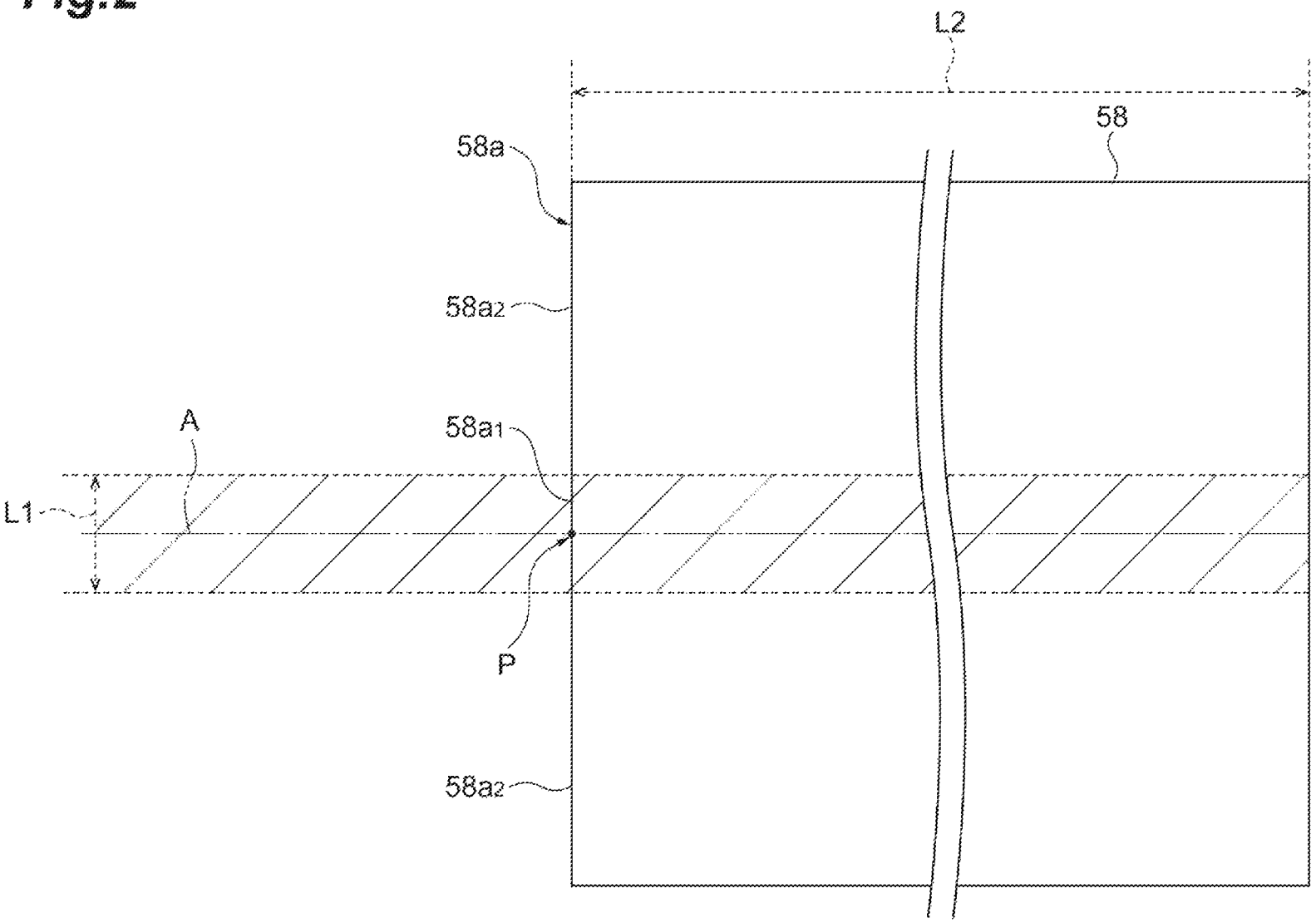
FIG. 2 is a diagram illustrating a center portion of an end surface of a piston portion where a contact point is located at an intermediate inclination angle.

FIG. 2 is a diagram illustrating the center portion 58$a_1$ of the end surface 58*a* of the piston portion 58 where the contact point P is located at the intermediate inclination angle. As illustrated in FIG. 2, the end surface 58*a* of the piston portion 58 includes the center portion 58$a_1$ which includes the axis center A and an outer peripheral portion 58$a_2$ which surrounds the center portion 58$a_1$. The center portion 58$a_1$ is an area when a predetermined area including the axis center A (an area indicated by hatching in the drawing) is viewed from the end surface 58*a* of the piston portion 58. That is, the center portion 58$a_1$ is a predetermined area which surrounds the axis center A about the axis center A. The center portion 58$a_1$ has an area smaller than the outer peripheral portion 58$a_2$. A diameter L1 in a direction orthogonal to the axis center A of the center portion 58$a_1$ is about 0.1 times an entire length L2 in the extension direction of the axis center A of the piston portion 58. For example, when the entire length L2 of the piston portion 58 is 40 mm, the diameter L1 of the center portion 58$a_1$ is about 4 mm.

The contact point P at the intermediate inclination angle is located to be included in the center portion 58$a_1$. That is, the contact point P at the intermediate inclination angle is located on the axis center A of the piston portion 58 or in the vicinity of the axis center A. Accordingly, it is possible to suppress a problem in which the displacement of the contact point P from the axis center A of the piston portion 58 excessively increases when the inclination angle of the swash plate 30 is located at any one of the maximal inclination angle and the minimal inclination angle.

Figure 4:
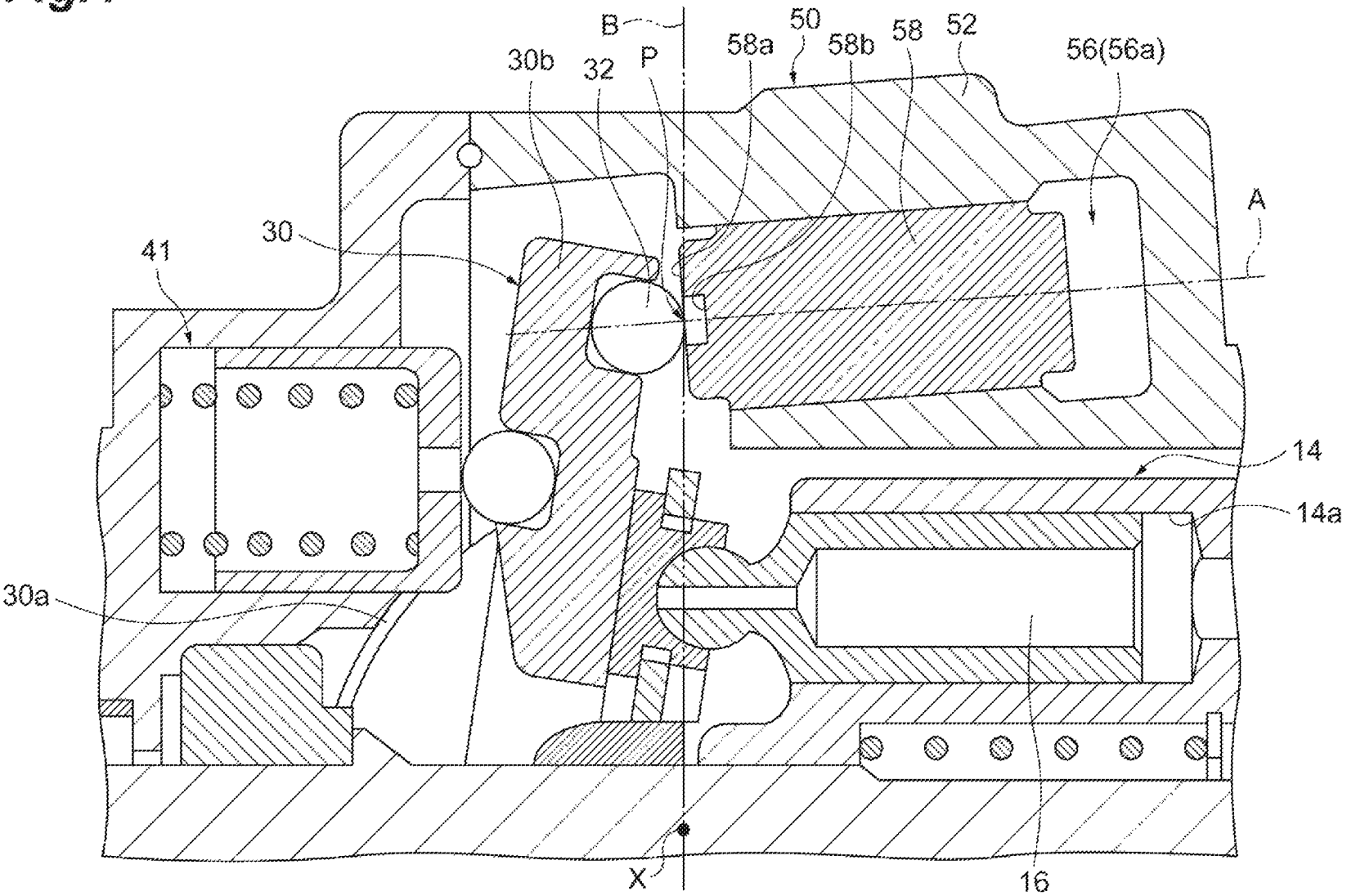
FIG. 4 is a schematic cross-sectional view illustrating a contact point between the piston portion and the roll at an intermediate inclination angle.

In the variable displacement pump 1 of the embodiment, when the inclination angle of the swash plate 30 is the intermediate inclination angle, the contact point P is located on the axis center A (see FIG. 4). A case where the contact point P is located on the axis center A of the piston portion 58 includes a case where the position of the contact point P is slightly displaced from the axis center A as well as a case where the position of the contact point P exactly overlaps the axis center A. For example, when the displacement of the position of the contact point P from the axis center A is within about 0.1 times of the entire length L2 of the piston portion 58, it may be considered that the contact point P is located on the axis center A.

Further, in the variable displacement pump 1 of the embodiment, when the inclination angle of the swash plate 30 is the intermediate inclination angle, the contact point P is located on the vertical reference line B (see FIG. 4). That is, when the inclination angle of the swash plate 30 is the intermediate inclination angle, the contact point P substantially matches the intersection point between the axis center A of the piston portion 58 and the vertical reference line B. The vertical reference line B indicates a line which is orthogonal to the axis center 20*a* of the rotation shaft 20 (see FIG. 1) and passes through the rotation center X.

A case where the contact point P is located on the vertical reference line B includes a case where the position of the contact point P is slightly displaced from the vertical reference line B as well as a case where the position of the contact point P exactly overlaps the vertical reference line B. For example, when the displacement of the position of the contact point P from the vertical reference line B is within about 1/10 of a difference $\alpha$ between the maximal inclination angle and the minimal inclination angle, it may be considered that the contact point P is located on the vertical reference line B.

In the variable displacement pump 1 of the embodiment, the swash plate 30, the roll 32, the piston portion 58, and the like are disposed so that the contact point P has the above-described positional relation when the inclination angle of the swash plate 30 is the intermediate inclination angle. For example, the above-described positional relation can be easily obtained by inclining the axis center A of the piston portion 58 with respect to the axis center 20*a* of the rotation shaft 20.

A recessed portion 58*b* is formed at the end surface 58*a* on the side of the swash plate 30 in the piston portion 58. The recessed portion 58*b* is formed within the movable range of the roll 32 on the end surface 58*a* of the piston portion 58. For example, the recessed portion 58*b* is formed in the vicinity of the center portion passing through the axis center A of the piston portion 58 in the end surface 58*a*.

The recessed portion 58*b* is opened, for example, in a substantially circular shape. For example, the recessed portion 58*b* has a diameter about 0.1 times the entire length L2 of the piston portion 58 about the axis center A of the piston portion 58. For example, the recessed portion 58*b* is recessed to the opposite side to the roll 32. The recessed portion 58*b* stores the working oil filled around the swash plate 30 etc. or the piston portion 58 inside the pump housing 10. The working oil stored in the recessed portion 58*b* is supplied to the roll 32 so that a part between the piston portion 58 and the roll 32 is reliably lubricated.

Figure 3:
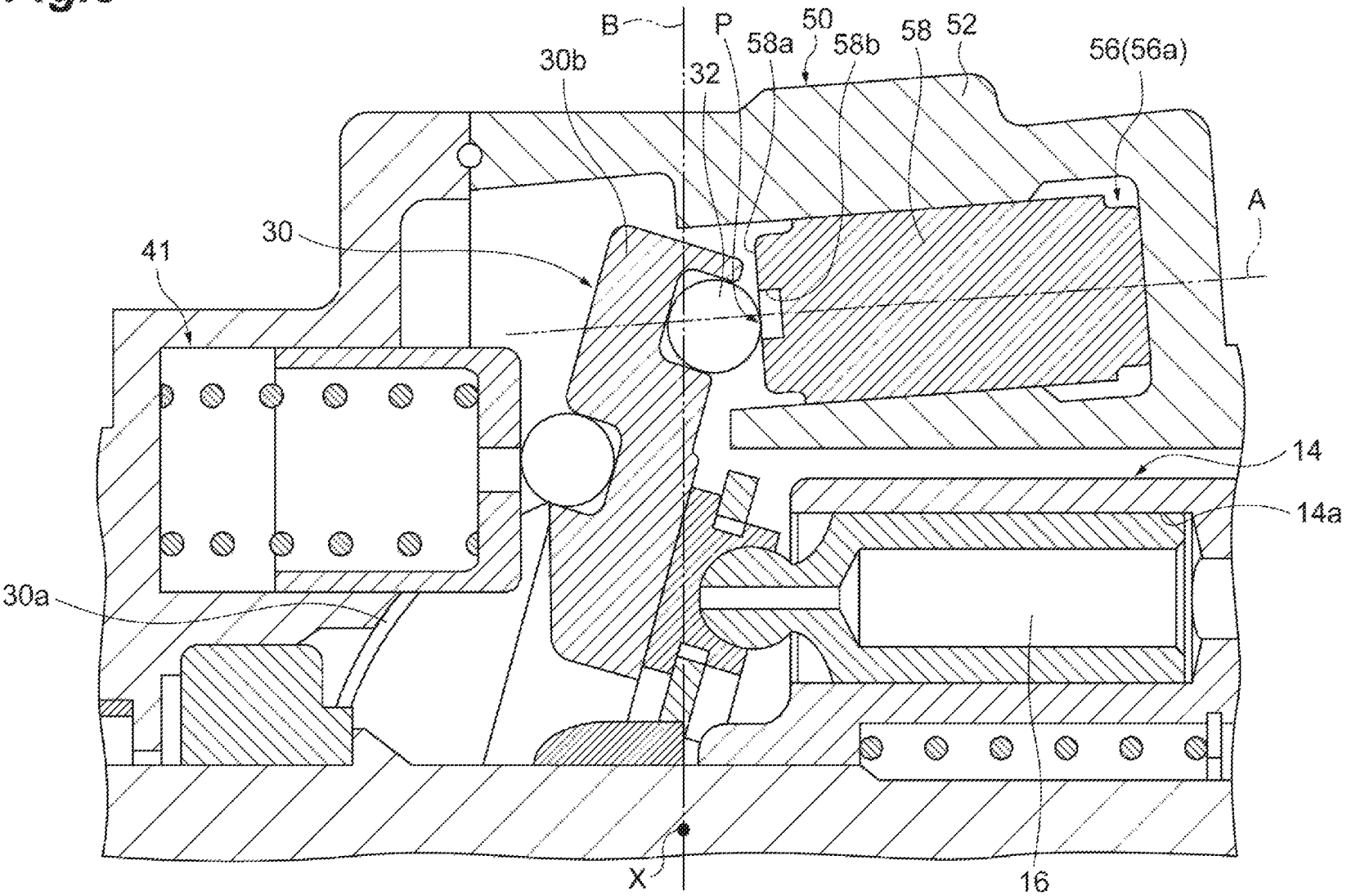
FIG. 3 is a schematic cross-sectional view illustrating a contact point between a piston portion and a roll at a maximal inclination angle.
Figure 5:
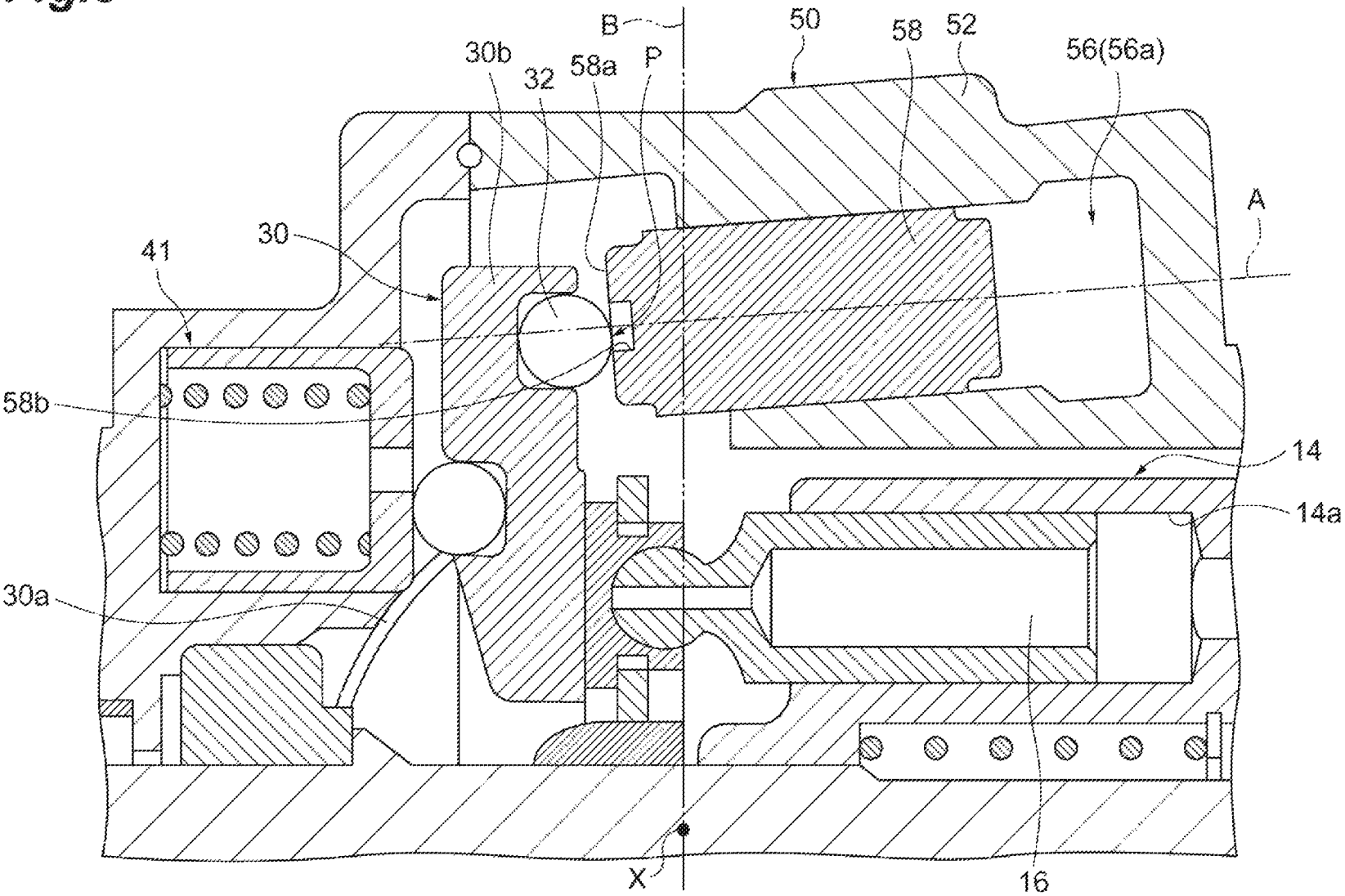
FIG. 5 is a schematic cross-sectional view illustrating a contact point between the piston portion and the roll at a minimal inclination angle.

Next, the displacement of the contact point P in response to the inclination angle of the swash plate 30 will be described with reference to FIGS. 3 to 5. FIG. 3 is a schematic cross-sectional view illustrating the contact point P at the maximal inclination angle. FIG. 4 is a schematic cross-sectional view illustrating the contact point P at the intermediate inclination angle. FIG. 5 is a schematic cross-sectional view illustrating the contact point P at the minimal inclination angle.

As illustrated in FIG. 4, the contact point P when the inclination angle of the swash plate 30 is at the intermediate inclination angle (for example, 10°) is located on the axis center A and the vertical reference line B as described above. When the inclination angle of the swash plate 30 is displaced between the maximal inclination angle and the minimal inclination angle in a case where the swash plate 30, the roll 32, the piston portion 58, and the like are disposed to satisfy such a positional relation, the position of the contact point P is displaced as illustrated in FIGS. 3, 4, and 5 in response to the displacement of the inclination angle in order of the maximal inclination angle, the intermediate inclination angle, and the minimal inclination angle.

As illustrated in FIG. 3, when the inclination angle of the swash plate 30 changes from the intermediate inclination angle to the maximal inclination angle (for example, 20°), the swash plate 30 is further inclined toward the piston portion 58. The swash plate 30 presses the end surface 58*a* of the piston portion 58 through the roll 32. The piston portion 58 slides inside the piston accommodation portion 52 by the pressing of the swash plate 30 and a substantially entire piston portion 58 is accommodated in the piston accommodation portion 52. At this time, the position of the contact point P is displaced to the lower side (the opposite side to the piston portion 58) of the axis center A in a direction perpendicular to the axis center A. Accordingly, the position of the contact point P is displaced to the lower side by, for example, about 0.1 times (more specifically, about 4 mm when the entire length L2 of the piston portion 58 is 40 mm) the entire length L2 of the piston portion 58 from the position on the axis center A in a direction perpendicular to the axis center A. That is, the position of the contact point P is displaced by, for example, about 0.1 times (more specifically, about 4 mm when the entire length L2 of the piston portion 58 is 40 mm) the entire length L2 of the piston portion 58 toward the outer peripheral side of the end surface 58*a* of the piston portion 58 based on the position on the axis center A.

Further, the position of the contact point P is displaced to the right side (toward the piston portion 58) of the position on the vertical reference line B in a direction perpendicular to the vertical reference line B. Accordingly, the position of the contact point P is displaced, for example, by about ½ of a difference α between the maximal inclination angle and the minimal inclination angle from the position on the vertical reference line B in a direction perpendicular to the vertical reference line B.

As illustrated in FIG. 5, when the inclination angle of the swash plate 30 changes from the intermediate inclination angle to the minimal inclination angle (for example, 0°), the working oil flows into the control room 56*a* so that the piston portion 58 is pressed from the piston accommodation portion 52 toward the swash plate 30. That is, the end surface 58*a* of the piston portion 58 presses the swash plate 30 through the roll 32. At this time, the position of the contact point P is displaced to the lower side (the opposite side to the piston portion 58) of the position on the axis center A in a direction perpendicular to the axis center A. Accordingly, the position of the contact point P is displaced, for example, by about 0.1 times (more specifically, about 4 mm when the entire length L2 of the piston portion 58 is 40 mm) the entire length L2 of the piston portion 58 from the position of the axis center A in a direction perpendicular to the axis center A. That is, the position of the contact point P is displaced by, for example, about 0.1 times (more specifically, about 4 mm when the entire length L2 of the piston portion 58 is 40 mm) the entire length L2 of the piston portion 58 toward the outer peripheral side of the end surface 58*a* of the piston portion 58 based on the position on the axis center A.

Further, the position of the contact point P is displaced to the left side (the opposite side to the piston portion 58) of the position on the vertical reference line B in a direction perpendicular to the vertical reference line B. Accordingly, the position of the contact point P is displaced by, for example, about ½ of a difference α between the maximal inclination angle and the minimal inclination angle from the position on the vertical reference line B in a direction perpendicular to the vertical reference line B.

As illustrated in FIGS. 3 and 5, the degree of the displacement of the contact point P from the axis center A is substantially the same when the inclination angle of the swash plate 30 changes from the intermediate inclination angle to the maximal inclination angle and when the inclination angle of the swash plate 30 changes from the intermediate inclination angle to the minimal inclination angle. That is, it is possible to suppress a problem in which the displacement of the contact point P from the position on the axis center A excessively increases when the inclination angle is any one of the maximal inclination angle and the minimal inclination angle. Accordingly, the displacement of the contact point P from the axis center A toward the outer peripheral side of the piston portion 58 does not easily increase excessively when the inclination angle of the swash plate 30 is any one of the maximal inclination angle and the minimal inclination angle.

Further, the degree of the displacement of the contact point P from the vertical reference line B is substantially the same when the inclination angle of the swash plate 30 changes from the intermediate inclination angle to the maximal inclination angle and when the inclination angle of the swash plate 30 changes from the intermediate inclination angle to the minimal inclination angle. That is, it is possible to suppress a problem in which the displacement of the contact point from the vertical reference line B excessively increases when the inclination angle is any one of the maximal inclination angle and the minimal inclination angle. Accordingly, the inclination of the swash plate 30 based on the vertical reference line B does not easily increase excessively when the inclination angle is any one of the maximal inclination angle and the minimal inclination angle. That is, the displacement of the inclination angle of the swash plate 30 based on the intermediate inclination angle decreases.

When the displacement of the contact point P occurs, a friction force is generated between the piston portion 58 and the roll 32. This friction force is one of factors causing a force in a direction in which the axis center A of the piston portion 58 is tilted (hereinafter, referred to as a "tilting force"). The direction in which the axis center A of the piston portion 58 is tilted indicates, for example, a direction in which the axis center A of the piston portion 58 is tilted from a direction along the axis center of the piston accommodation portion 52. Since a load applied to a part of the end surface 58*a* of the piston portion 58 increases as the displacement of the contact point P from the position on the axis center A toward the outer peripheral side of the piston portion 58 increases, only a part of the end surface 58*a* is worn. When only a part of the end surface 58*a* is worn, the piston portion 58 and the roll 32 easily come into point-contact with each other instead of a surface contact and thus a pressure at the contact portion between the piston portion 58 and the roll 32 increases. As a result, a large tilting force is applied to the piston portion 58.

According to the variable displacement pump 1 of the embodiment, when the inclination angle of the swash plate 30 is the intermediate inclination angle, the contact point P is located at the center portion 58$a_1$ in the end surface 58*a* of the piston portion 58. That is, the contact point P is located on the axis center A of the piston portion 58 or in the vicinity of the axis center A. With such a positional relation, the displacement of the contact point P from the axis center A of the piston portion 58 toward the outer peripheral side of the piston portion 58 does not easily increase excessively when the inclination angle of the swash plate 30 is any one of the maximal inclination angle and the minimal inclination angle. For this reason, it is possible to suppress the tilting force applied to the piston portion 58. Thus, it is possible to suppress the wear of the piston accommodation portion 52 generated when the piston portion 58 slides inside the piston accommodation portion 52 while the tilting force is applied to the piston portion and to suppress the wear of the pump housing 10.

According to the variable displacement pump 1, since the displacement of the contact point from the axis center of the piston portion 58 toward the outer peripheral side of the piston portion is substantially the same when the inclination angle of the swash plate is the maximal inclination angle and when the inclination angle of the swash plate is the minimal inclination angle, it is possible to further suppress the tilting force applied to the piston portion 58. Thus, it is possible to further suppress the wear of the piston accommodation portion 52 generated when the piston portion 58 slides inside the piston accommodation portion 52 while the tilting force is applied to the piston portion and to further suppress the wear of the pump housing 10.

According to the variable displacement pump 1, the inclination of the swash plate 30 based on the vertical reference line B does not easily increase excessively when the inclination angle of the swash plate 30 is any one of the maximal inclination angle and the minimal inclination angle. That is, the displacement of the inclination angle of the swash plate 30 based on the intermediate inclination angle is small. Thus, since it is possible to decrease the degree of the displacement of the contact point P in response to the displacement of the inclination angle of the swash plate 30, it is possible to further suppress the tilting force applied to the piston portion 58 due to the displacement of the contact point P. As a result, it is possible to further suppress the wear of the piston accommodation portion 52 and to further suppress the wear of the pump housing 10.

The working oil is filled around the swash plate 30 etc. or the piston portion 58 inside the pump housing 10. However, for example, when the end surface 58*a* of the piston portion 58 is worn by the roll 32, there is a case where a part between the end surface 58*a* of the piston portion 58 and the roll 32 is not sufficiently lubricated depending on the working oil filled around the swash plate or the piston portion. According to the variable displacement pump 1 of the embodiment, the working oil filled around the piston portion 58 or the swash plate 30 etc. is stored in the recessed portion 58*b* formed in the end surface 58*a* of the piston portion 58. Thus, since a part between the piston portion 58 and the roll 32 is reliably lubricated by the working oil stored in the recessed portion 58*b*, a friction force generated by the displacement of the contact point P is reduced. Since the friction force is one of factors causing the tilting force applied to the piston portion 58, it is possible to further suppress the tilting force applied to the piston portion 58 by reducing the friction force. Accordingly, it is possible to further suppress the wear of the piston accommodation portion 52 generated when the piston portion 58 slides inside the piston accommodation portion 52 while the tilting force is applied to the piston portion and to further suppress the wear of the pump housing 10.

According to the variable displacement pump 1, the axis center A of the piston portion 58 is inclined with respect to the axis center 20*a* of the rotation shaft 20. When the contact point P is located at the center portion 58$a_1$ of the end surface 58*a* of the piston portion 58 in a case where the axis center A of the piston portion 58 is parallel to the axis center 20*a* of the rotation shaft 20, for example, it is not easy in that the size of the swash plate 30 etc. needs to be changed or the piston portion 58 and the rotation center X need to be disposed to be adjacent to each other. Since the axis center A of the piston portion 58 is inclined with respect to the axis center 20*a* of the rotation shaft 20, the contact point P can be easily located at the center portion 58$a_1$ of the end surface 58*a* of the piston portion 58 even when the size of the swash plate 30 etc. is not changed. As a result, a decrease in size can be realized.

Although the embodiment of the invention has been described above, the invention is not limited to the above-described embodiment. For example, the invention may be modified within the scope not changing the gist described in each claim or may be applied to other applications.

In the above-described embodiment, the contact point P is located on the axis center A and the vertical reference line B when the inclination angle of the swash plate 30 is the intermediate inclination angle, but the invention is not limited thereto. The contact point P when the inclination angle of the swash plate 30 is the intermediate inclination angle may be located in at least the center portion 58$a_1$ of the end surface 58*a* of the piston portion 58, but may not be located on the axis center A or the vertical reference line B.

The piston accommodation portion 52 and the piston portion 58 may not extend in a direction inclined with respect to the rotation shaft 20. That is, the axis center of the piston accommodation portion 52 and the axis center A of the piston portion 58 may extend in, for example, a direction parallel to the axis center 20*a* of the rotation shaft 20.

The recessed portion 58*b* may not be substantially circular and may be opened, for example, in various shapes including a substantially rectangular shape or a substantially triangular shape.

REFERENCE SIGNS LIST

1: variable displacement pump, 10: pump housing (housing), 14: cylinder block, 14*a*: cylinder bore, 16: piston, 20:

rotation shaft, 20*a*: axis center, 30: swash plate, 32: roll (pressed portion), 50: control piston, 58: piston portion, 58*a*: end surface, 58$a_1$: center portion, 58*b*: recessed portion, P: contact point, A: axis center, B: vertical reference line, X: rotation center.

The invention claimed is:

1. A variable displacement pump which includes a rotation shaft rotatably supported by a housing, a cylinder block including a plurality of cylinder bores formed in the rotation shaft in a circumferential direction and rotating together with the rotation shaft, a plurality of pistons, wherein each piston is provided within a respective one of the cylinder bores, to be slidable, and a swash plate supported to be tiltable with respect to the rotation shaft while a front end portion of each piston is slidable thereon, the swash plate being configured to suck and discharge a working fluid by moving each piston in a reciprocating manner with a stroke in response to an inclination angle of the swash plate, the variable displacement pump comprising:

a control piston which includes a columnar piston portion pressing the swash plate and adjusts the inclination angle of the swash plate between a maximum inclination angle in which a discharge capacity of the working fluid becomes maximal and a minimum inclination angle in which the discharge capacity of the working fluid becomes minimal;

a piston accommodation portion which is formed in the housing and accommodates the piston portion; and a pressed portion which is disposed between the swash plate and the piston portion and is pressed toward the swash plate by the piston portion, wherein the pressed portion is a cylindrical roll;

a central axis of the piston portion is inclined with respect to a central axis of the rotation shaft;

when the inclination angle of the swash plate is an intermediate inclination angle in which the discharge capacity of the working fluid becomes an intermediate amount between the maximal amount and the minimal amount, a contact point between the piston portion and the pressed portion is located on the central axis of the piston portion in an end surface on the side of the swash plate in the piston portion;

when the inclination angle of the swash plate is the maximum inclination angle and the minimum inclination angle, the contact point is located on a position displaced from the central axis of the piston portion;

when the inclination angle of the swash plate is the intermediate inclination angle, the contact point is located on the central axis of the piston portion; and wherein when the inclination angle of the swash plate is the intermediate inclination angle, the contact point is located on a vertical reference line orthogonal to the central axis of the rotation shaft and passing through a rotation center of the swash plate.

2. The variable displacement pump according to claim 1, further comprising a recessed portion which is formed in an end surface on the side of the swash plate in the piston portion.

* * * * *